United States Patent [19]

Martin et al.

[11] 4,121,549

[45] Oct. 24, 1978

[54] APPARATUS FOR METERING FUEL AND AIR FOR AN ENGINE

[75] Inventors: Barrie James Martin, Shenfield; Michael John Broad, Lyng; Samuel Stewart Hall, Hornchurch, all of Great Britain

[73] Assignee: Plessey Handel und Investments AG, Zug, Switzerland

[21] Appl. No.: 759,475

[22] Filed: Jan. 14, 1977

[30] Foreign Application Priority Data

Jan. 14, 1976 [GB] United Kingdom ..... 1473/76

[51] Int. Cl.[2] ..... F02B 3/00; F02M 7/00

[52] U.S. Cl. ..... 123/32 EA; 123/119 EE; 123/32 EJ

[58] Field of Search ..... 123/32 EJ, 119 EE, 32 PA

[56] References Cited

U.S. PATENT DOCUMENTS

| | | | |
|---|---|---|---|
| 2,753,595 | 11/1948 | Rosenthal | 123/119 EE |
| 2,908,443 | 10/1959 | Fruengel | 123/119 EE |
| 3,522,794 | 8/1970 | Reichardt | 123/32 CA |
| 3,722,275 | 3/1973 | Rodely | 123/32 EJ |
| 3,818,877 | 6/1974 | Barrera et al. | 123/32 EA |
| 3,956,928 | 5/1976 | Barrera | 123/32 EJ |

*Primary Examiner*—Ronald B. Cox

*Attorney, Agent, or Firm*—Fleit & Jacobson

[57] ABSTRACT

Apparatus for metering fuel and air for an engine, which apparatus comprises air flow measuring means which measures at least a part of the flow of air for the engine and which generates an electrical output that is proportional to the measured air flow, control means which receives the output from the air flow measuring means and which generates electrical output signals which vary in dependence upon the received signals, and an injector which injects fuel in response to the signals from the control means. Preferably the apparatus of the invention includes fuel dissipating means, such as a heat pipe or a sonic nozzle, for finely atomizing the injected fuel.

11 Claims, 4 Drawing Figures

APPARATUS FOR METERING FUEL AND AIR FOR AN ENGINE

This invention relates to apparatus for metering fuel and air for an engine.

Accordingly, this invention provides apparatus for metering fuel and air for an engine, which apparatus comprises air flow measuring means which measures at least a part of the flow of air for the engine and which generates an electrical output that is proportional to the measured air flow, control means which receives the output from the air flow measuring means and which generates electrical output signals which vary in dependence upon the received signals, and an injector which injects fuel in response to the signals from the control means.

The apparatus of the invention can be effective for providing an optimum amount of fuel and air for an engine under varying conditions. Precise control is achieved by utilising the air flow for the engine. More specifically, the use of the air flow measuring means enables a continuous check on the condition of the air ultimately destined for an engine. The data obtained by the air flow measuring means can then be fed to the control means and the control means can then appropriately control the injection of fuel into the air.

Various types of injector may be used in the present invention. Preferably, the injector has a ball valve effective to shut-off the fuel flow when the injector is not being vibrated. Examples of appropriate injectors that may be used are described in our U.S. Pat. No. 3,884,417 and G.B. Pat. No. 1,415,539, and in our U.S. Pat. No. 3,949,938 and U.S. Pat. application Ser. Nos. 695,156, 660,929 filed on Feb. 24, 1976, now pending, 596,205 filed on July 15, 1975, now pending and 715,006 filed on Aug. 17, 1976. The injector is preferably a vibratory injector which is vibrated by means of a piezoelectric device but it may also be vibrated by other devices.

The injected fuel should preferably be in a finely atomized form so that it can be fully mixed with the air. Accordingly the apparatus of the invention preferably includes fuel dissipating means for dissipating, i.e. finely atomizing, at least a part of the injected fuel. Thus the correct quantity of fuel can be injected into the air under the control of the control means and then this correct quantity of fuel can be substantially fully dissipated utilising the fuel dissipating means.

The apparatus of the present invention may be used for various types of engines such for example as two and four stroke internal combustion engines, diesel engines and gas turbines.

Usually the output from the air flow measuring means will be a series of electrical pulses of a frequency determined by the air volume flow through the air flow measuring means. Preferably, the air flow measuring means is a vortex shedding flow meter having a pressure or a temperature transducer. Such a vortex shedding flow meter may have a bluff body which causes the air passing the bluff body to form vortices alternatively from either side of the bluff body. The oscillation within the air flow can then be sensed by the pressure or temperature transducer. Other types of apparatus can be used if desired such for example as air flow measuring means which gives an output dependent upon temperature changes caused by varying air flow. Still further, the air flow measuring means may be a fluidic device, e.g. a fluidic switching device in which the air switches between two channels.

The air flow measuring means may be arranged in the main air duct leading to the engine. In this case, all the air for the engine is measured. Alternatively, the air flow measuring means can be arranged in a by-pass air duct so that only a proportion of the air for the engine is measured. In this latter case, the fuel is preferably injected into the main air duct but, if desired, it can be mixed with the air in the by-pass duct and then this mixture can be combined in the main air duct with the remaining flow of air destined for the engine prior to the introduction of the fuel/air mixture into the engine.

Advantageously, the injector and the surface to be vibrated are both positioned in the vicinity of an inlet manifold for an engine. Since the fuel injector and the surface are positioned in the vicinity of the inlet manifold, the fuel does not have to pass along an appreciable length of an air induction pipe leading to the inlet manifold. It can sometimes be disadvantageous to inject the fuel in the air induction pipe an appreciable distance from the inlet manifold since the fuel will obviously wet the walls of the induction pipe. When the engine is being driven and power is no longer required, the operator will release the throttle to cause the engine revolutions to subside and a correspondingly smaller amount of fuel to be injected from the injector. This may often cause a suction effect at the inlet manifold which can act to suck the petrol off the walls of the induction pipe and into the engine at a time when this additional fuel is not required. By appropriately positioning the injector and the surface to be vibrated near the manifold, this disadvantageous effect can be substantially prevented.

The control means may be a digital computer device. An analogue computer device may also be used. Preferably, the control means actuates the injector on a predetermined pulse width per signal.

The control means may include a monostable device effective to receive the pulses from the air flow measuring means and to generate pulses of an appropriate predetermined pulse width. The monostable device may have a fixed multiplication or division factor so that it is able to generate output pulses which are in a fixed ratio to the input pulses. The width of the pulses can be altered to enable the air/fuel ratio either to be kept constant when the air temperature may be causing variations in the air mass flow, or to be varied (e.g. by using the engine throttle) to enable the engine to respond to transient demands made upon it. The air/fuel ratio can be enriched for engine accelerations and weakened for engine decelerations and on over-run. The air/fuel ratio can also be adjusted for other varying engine conditions such for example as when the temperature of any coolant for the engine varies or when the output of any battery associated with the engine drops too low. If desired, the apparatus of the invention may also include an oxygen sensor which may be located in the exhaust duct from the engine. This oxygen sensor may provide a feedback signal from the engine exhaust to the control means and may be effective to ensure that the fuel supplied to the engine is correct to maintain a desired optimum air/fuel ratio, e.g. 15:1 by mass.

The output pulses from the monostable device may be fed to an oscillator which is effective to actuate the injector and cause it to vibrate. Various types of oscillator and associated circuitry may be utilised and an example of one suitable oscillator and associated circuitry is described in our co-pending U.S. pat. application Ser.

No. 723,668, now abandoned. A solenoid operated valve may also be employed.

It may be necessary due to practical problems such for example as slow injector valve closing or poor metering accuracy at low pulse widths, for the ratio of injector pulses to air flow meter pulses to be varied at predetermined flow meter rates and to have the pulse width varied accordingly. For example, one injector pulse per induction stroke of an engine at idle conditions may require a 1 millisecond pulse on the injector. At high loads, one induction stroke may require five of the 1 millisecond pulses. At this point, the control means could be set such that it changes the ratio from 1:1 to 1:5 with the pulse width increased to 5 milliseconds, providing the flow from the injector is proportional. If the flow from the injector is not proportional, then the pulse width is adjusted and not the ratio.

When the apparatus of the invention is to include fuel dissipating means, then various types of fuel dissipating means may be utilised. Thus, for example, the fuel dissipating means may be fuel vapourising means. The fuel vapourising means may be any device to heat up the part of the air duct into which the fuel is injected. In this case, the fuel vapourising means is preferably a heat pipe.

Heat pipes are well known per se. Thus, as is known, a heat pipe is in effect a sealed container containing a vapourisable and recondensable material such for example as water or sodium. The heat pipe collects heat from the exhaust part of the engine and this causes the vapourisable material to vapourise. The vapour travels to the cooler parts of the heat pipe, which in the present case will be arranged in or around that part of the air duct into which the fuel is introduced. The vapourised material gives up its heat and recondenses. The condensed material or liquid runs back to the hotter part of the heat pipe for re-vapourisation, for example along a wick arranged in and forming part of the heat pipe. The heat given up to the air duct will assist in vapourising the fuel. When the heat pipe is arranged in the air duct then, if desired, the fuel may be directed directly towards the heat pipe so that any non-atomized fuel will impinge directly on the heat pipe.

As an alternative to the fuel vapourising means, the fuel dissipating means may be a sonic nozzle. The sonic nozzle may be such that the injector introduces the fuel just upstream of the nozzle which is choked at all low speed low load engine conditions. As the injected fuel strikes the contours of the passage, shock waves are set up which further break up the fuel.

A still further alternative fuel dissipating means is a device having a surface that is adapted to be vibrated. The surface can be on a plate or a disc and the plate or disc is preferably sufficiently thin that the plate or disc vibrates along its own plane to produce vibration nodes and anti-nodes. Appropriate surface atomizers are described in our co-pending British Cognate Patent Application Nos. 1458/76 and 16419/76 corresponding to copending U.S. application, Ser. No. 759,476, filed on Jan. 14, 1977.

Embodiments of the invention will be described solely by way of example and with reference to the accompanying drawings in which.

Figure 1:
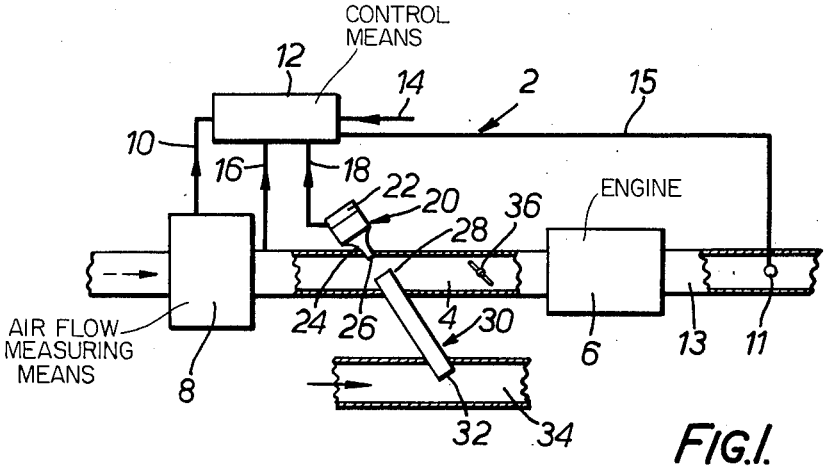
FIG. 1 shows first apparatus in accordance with the invention for metering fuel and air for an engine.

Referring now to FIG. 1, there is shown apparatus 2 for metering fuel in accordance with air in an air duct 4 leading to an engine 6. The apparatus 2 comprises air fow measuring means 8 which is arranged directly in the duct 4 and which therefore measures all of the air flow for the engine 6. The measuring means 8 causes an oscillation of the air to be set up with the frequency of oscillation being proportional to the air flow rate. These oscillations are converted into electrical pulses by means of a pressure or flow sensitive element forming part of the measuring means 8. The measuring means 8 thus generates electrical pulses of a frequency proportional to the measured air volume flow.

The output from the measuring means 8 passes along line 10 to control means 12. The control means 12 is also fed with information such for example as acceleration of the engine via line 14, air temperature in the duct 4 via line 16, battery output voltage via line 17, and engine coolant temperature via line 19. The air and engine coolant temperatures can be measured by appropriately positioned thermistors. When the engine is cold, more fuel may be needed, thus providing a "choke" function. When the vehicle is accelerating, more fuel may temporarily be needed to ensure freedom from engine flat spots. This may be accomplished by a throttle movement rate sensor, which ensures that the fuel:air ratio is increased whenever the vehicle driver demands an acceleration by causing appropriate electrical signals to pass along the line 14.

The control means 12 is thus fed with information which is relevant to the proportion of fuel to air needed by the engine. The control means 12 then generates an appropriate train of square pulses of predetermined width along line 18 which is effective to cause injection of exactly the right amount of fuel into the duct 4 from an injector 20. The width of the pulses is primarily determined by the air flow rate in the duct 4, but modified by the above mentioned control parameters such for example as engine acceleration and air and engine coolant temperatures.

The width of the pulses may also be modified by the optional presence of an oxygen sensor 11 arranged in the exhaust duct 13 of the engine 6. The oxygen sensor 11 monitors the oxygen content of the exhaust and is effective to provide a signal in line 15 indicative of the air/fuel ratio at which the engine is operating. This signal is fed via the line 15 to the control means 12 and may serve to specify the required air/fuel ratio. During acceleration and deceleration of the engine 6, the signal from the oxygen sensor 11 will normally be over-ridden by the throttle movement sensor so that temporary changes in the air/fuel ratio are permitted. This ensures that full driveability of the vehicle is maintained when acceleration is demanded and that minimum fuel is provided during deceleration demands.

The injector 20 is a vibratory type of injector and the line 18 is connected to a piezoelectric crystal 22 forming part of the injector. The electric signals actuate the piezoelectric crystal 22 and the injector is caused to vibrate. Fuel injected by the injector when it is being vibrated is in the form of a spray. The vibrations, which are preferably ultrasonic, are magnified in the horn portion 24 of the injector 20. Usually the tip 26 of the horn portion 24 will have an orifice therein which is closed by means of a non-return valve. Preferably the non-return valve is a ball valve. When a ball valve is used, it is preferably positioned in a separate housing in the nozzle tip 26 and this housing may be provided with various apertures for causing the fuel to swirl in the housing and also for causing the ball valve to be pushed by the fuel in the housing towards the nozzle orifice.

It will be seen from FIG. 1 that positioned adjacent the nozzle 20 and arranged in the duct 4 is one end 28 of a heat pipe 30. The presence of the heat pipe 30 is optional. The other end 32 of the heat pipe 30 is positioned in an exhaust manifold 34 for the engine 6. The heat pipe 30 is effectively a closed container and may contain water or other vapourisable material such for example as sodium. The vapourisable material is vapourised at the end 32 of the heat pipe due to the hot gases existing in the exhaust manifold 34. The vapourised material passes along the heat pipe 30 to the end 28. The end 28 is cooler than the vapourised material and the vapourised material gives up its heat at the point 28 and recondenses. The re-condensed material flows back along a wick (not shown) inside the heat pipe 30 to the end 32 where it is to be re-vapourised again. The heat given up at the end 28 assists in vapourising the fuel injected from the nozzle 20. The fuel injected from the nozzle 20 can be arranged to contact the hot end 28 of the heat pipe 30 is desired. Alternatively, the injected fuel can be arranged to be injected in a general hot area heated by the heat pipe. The fully vapourised and correctly mixed fuel/air mixture can then pass through a normal butterfly throttle 36 to the engine 6 for combustion.

Figure 2:
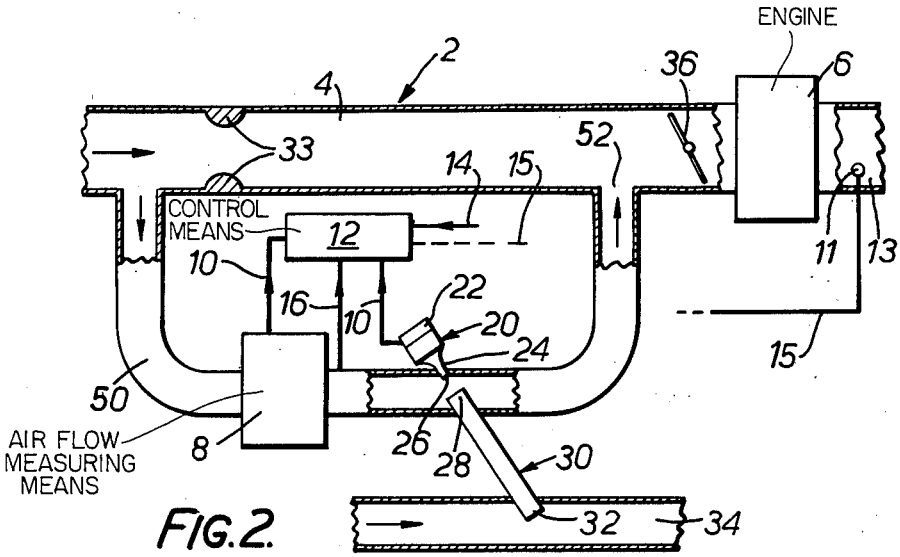
FIG. 2 shows a second apparatus in accordance with the invention for metering fuel and air for an engine.

Referring now to FIG. 2, similar apparatus to that shown in FIG. 1 has been illustrated and similar parts have been given the same reference numeral. In the embodiment shown in FIG. 2, it will be seen that the air fow measuring means 8 is not positioned in the main air flow duct 4 but is positioned in a by-pass duct 50. The air flow measuring means 8 thus measures a proportion of the air ultimately destined for the engine 6.

The injector 20 and the heat pipe 30 are also positioned in the duct 50. The full amount of fuel needed for the engine 6 is injected by the injector 20 into the air in the duct 50. This mixture of fuel and air is then passed back into the main duct 4 at orifice 52 and the correct air/fuel mixture then passes past the butterfly throttle 36 to the engine 6. A restrictor 33 may optionally be employed in the duct 4 for ensuring that there is a constant ratio of the air flow through the main duct 4 and the by-pass duct 50.

Figure 3:
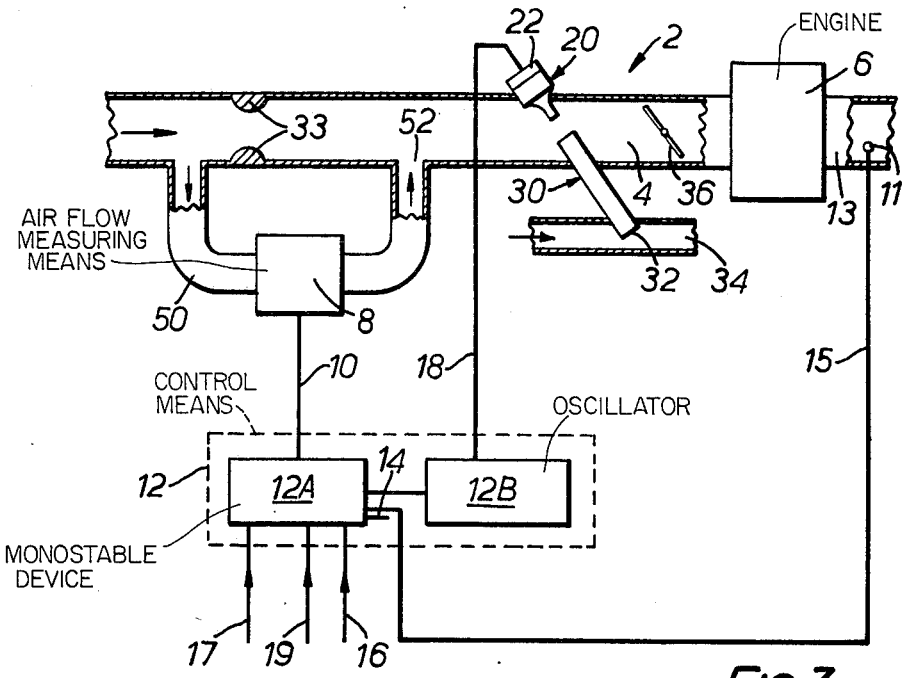
FIG. 3 shows a third apparatus in accordance with the invention for metering fuel and air for an engine.

Referring now to FIG. 3, similar apparatus to that shown in FIGS. 1 and 2 has been illustrated and similar parts have been given the same reference numeral. In the embodiment shown in FIG. 3, it will be seen that the air flow measuring means 8 is positioned in the by-pass duct 50 but the injector 20 and the heat pipe 30 are positioned in the main duct 4.

In the embodiment of FIG. 3, it may be desired to obtain a ratio of 16:1 or 17:1 of air mass:fuel. Also, the pulses passing along line 18 for actuating the injector 20 may be 1 millisecond pulses at engine tick over speeds.

In FIG. 3, it will be noted that the control means 12 has been formed as two separate units comprising a monostable device 12A and an oscillator 12B, e.g. of the type described in our co-pending patent application No. 38470/75 corresponding to U.S. application, Ser. No. 723,668, now abandoned. The monostable device 12A is fed with electrical pulses from the air flow measuring means 8, the frequency of the pulses being determined by the mass of air in the bypass duct 50. The monostable device 12A is also fed with information that can affect the fuel/air ratio of the combustion mixture for the engine 6. This information can be information on throttle movement via line 14, air temperature in the duct 4 via line 16, battery output voltage via line 17 and engine coolant temperature via line 19. The monostable device 12A is effective to digest the information received and to generate a train of pulses of predetermined width and of a frequency which fires the oscillator 12B for the required periods of time. The injector 20 injects fuel for the required periods of time consequent upon being activated by the oscillator 12B.

In three further embodiments of the invention, the air/fuel metering apparatus can be as shown in FIGS. 1 to 3 but without the presence of the fuel vapourising means 30. The systems illustrated in FIGS. 1 to 3 will then rely for efficient fuel atomization solely on the atomization produced by the injectors 20.

When the systems illustrated in FIGS. 1 to 3 are operated without the oxygen sensor 11, electrical shaping circuits will preferably be included in the control means to ensure that the desired fuel quantity is supplied irrespective of non-linearities within any monitoring instruments or the engine 6.

Figure 4:
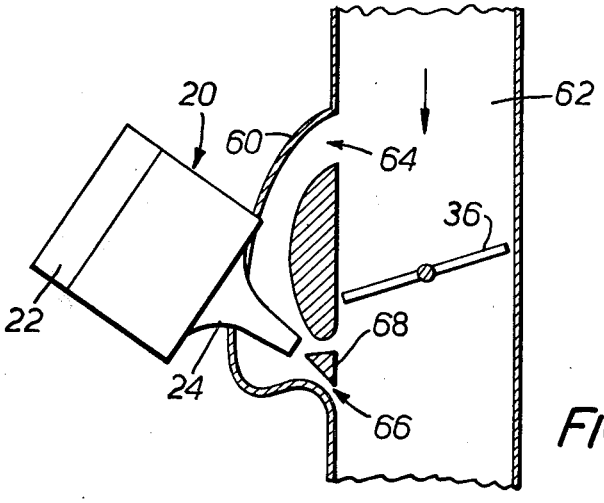
FIG. 4 shows part of fourth apparatus in accordance with the invention for metering fuel and air for an engine.

Referrig now to FIG. 4, there is shown an injector 20 comprising the piezoelectric crystal 22 and the horn portion 24 as in FIGS. 1 to 3. The injector 20 is arranged in a passage 60. The passage 60 leads off a main air duct 62. The passage 60 has an inlet 64 and an outlet 66. A slug or other baffle 68 is preferably arranged in the outlet 66.

The passage 60 bypasses the throttle 36. The size of this passage 60 is such that there is sufficient air flow through it to carry the fuel away from the atomizer tip and into the main duct 62 but not sufficient to enable the engine to idle without some small quantity of air passing through the throttle 36.

At low engine loads and speeds the pressure ratio across the throttle will be such that the air flow through the nozzle 66 will be choked and the fuel particles accelerating through this nozzle will elongate and then be further broken up by passing through the shock waves generated downstream of the nozzle 66 and the throttle 36.

At higher engine loads and speeds, the air flow will be much more turbulent and the need for further atomization less important.

It is to be appreciated that the embodiments of the invention described above have been given by way by example and that modifications may be effected. Thus, for example, a different type of injector 20 could be utilised. Thus, for example, the injector 20 could be electro-magnetically operated, e.g. a magnetostrictive device, or the injector could be one without a non-return ball valve. Alonly one injector 20 has been shown, more injectors could be employed if desired. For example, in the case of a V-8 engine, two injectors 20 could be employed, each feeding an intake manifold for four cylinders. Still further a low flow rate injector 20 could be employed for one part of an engine operating mode and a high flow rate injector 20 could be employed in the same system but for a different part of the engine operating mode. For high speed high load conditions, both injectors may be used.

At cranking speed, the air being inspired into the engine may not be of sufficient velocity to enable the air flow measuring means to work adequately. At these conditions, the injector may be commanded by the ignition pulses of the engine. When the output, e.g. air pulses, from the air flow measuring means are of a sufficient frequency, the electrical circuit will sense this and will change the command from the ignition pulses to the air flow measuring means.

What we claim is:

1. Apparatus for metering fuel and air for an engine, which apparatus comprises air flow measuring means means comprising a vortex shedding flow meter which measures at least a part of the flow of air for the engine and which generates an electrical output that is proportional to the measured air flow, control means which receives the output from the vortex shedding flow meter and which generates electrical output signals which vary in dependence upon the received signals, and an injector which injects fuel in response to the signals from the control means, means for interconnecting said control means with said injector for activating the injector by a number of times in any given period directly proportional to the number of vortices shed by the vortex shedding flow meter, and fuel dissipating means for dissipating at least a part of the injected fuel.

2. Apparatus according to claim 1 in which the injector is a vibratory injector which is vibrated by means of a piezoelectric device.

3. Apparatus according to claim 1 in which the flow meter includes a pressure transducer.

4. Apparatus according to claim 1 in which the flow meter includes a temperature transducer.

5. Apparatus according to claim 1 in which the control means includes a monostable device effective to receive the pulses from the vortex shedding flow meter and to generate pulses of a predetermined width, and in which the control means includes an oscillator, the apparatus being such that in use the output pulses from the monostable device are fed to the oscillator which is effective to actuate the injector.

6. Apparatus according to claim 1 in which the fuel dissipating means is fuel vapourising means.

7. Apparatus according to claim 1 in which the fuel dissipating means is a sonic nozzle.

8. Apparatus according to claim 1 in which the fuel dissipating means is a flat surface which is adapted to be vibrated.

9. Apparatus according to claim 6, wherein said injector injects fuel into an air duct, and wherein said fuel vapourizing means comprises means for heating that part of said air duct into which the fuel is injected.

10. Apparatus according to claim 9, wherein said means for heating comprises a sealed container heat pipe containing vapourizable and recondensable material therein, one end of said heat pipe positioned within that part of said air duct into which the fuel is injected, and the other end of said heat pipe positioned at a temperature greater than the temperature within said air duct, wherein heat transfers from the high temperature end of said heat pipe to said one end of said heat pipe.

11. Apparatus according to claim 10, wherein said other end of said heat pipe is positioned in an exhaust manifold of said engine.

* * * * *